United States Patent [19]

Karnis et al.

[11] 4,135,389

[45] Jan. 23, 1979

[54] SPECIFIC SURFACE FRACTIONATOR

[75] Inventors: Alkibiadis Karnis, Dollard des Ormeaux; John R. Wood, Dorion, both of Canada

[73] Assignee: Domtar Inc., Montreal, Canada

[21] Appl. No.: 803,623

[22] Filed: Jun. 6, 1977

[51] Int. Cl.[2] ..... G01N 33/34

[52] U.S. Cl. ..... 73/61.4; 209/10; 209/211

[58] Field of Search ..... 209/1, 10, 208, 209, 209/211; 73/63, 61 R, 61.4, 53, 432 PS

[56] References Cited

U.S. PATENT DOCUMENTS

| | | | |
|---|---|---|---|
| 2,504,944 | 4/1950 | Atkinson | 209/211 |
| 3,085,927 | 4/1963 | Pesch | 209/211 X |
| 3,352,745 | 11/1967 | Malm | 209/211 X |
| 3,873,416 | 3/1975 | Forgacs | 73/63 X |

*Primary Examiner*—Ralph J. Hill
*Attorney, Agent, or Firm*—C. A. Rowley

[57] ABSTRACT

A method and apparatus for determining the fractional distribution of fibers by specific surface in a sample of mechanically treated pulp comprising: a hydrocyclone, at least two collecting chambers, a pump to feed pulp to said hydrocyclone, means to selectively connect the pump inlet with each chamber and means to selectively connect one of the outlets of the hydrocyclone to a selected chamber.

10 Claims, 2 Drawing Figures

SPECIFIC SURFACE FRACTIONATOR

The present invention relates to an apparatus for determining the fractional distribution by weight of fibre specific surface, in a cellulose pulp which has undergone mechanical treatment. It relates more particularly to a specific surface fractionator for mechanical pulps.

BACKGROUND OF THE INVENTION

The specific surface is a physical property of pulps which is gaining more and more attention, particularly where mechanical pulps are concerned. The property is generally connected with the degree of surface development of individual fibres resulting from beating or refining (in a refiner), hence its importance in pulps which are made by mechanical means or which, if chemically made, are subjected to beating. It is defined as the total surface per unit weight of a pulp and it can be measured, of course indirectly, e.g. by the method described in the paper by A. A. Robertson and S. G. Mason (Pulp and Paper Magazine of Canada, December 1949, p.103–110).

While the average specific surface of a mechanical pulp is of interest per se for the characterization of mechanical pulps and for the development of on-line controls in the production of such pulps, more recently attention has been directed to the fractional distribution by weight of fibre specific surface of such pulps i.e., obtained by the fractionating of such pulps into several fractions, in increasing or decreasing order of values of specific surface, and the measuring of the specific surface of the respective fractions. In co-pending United States patent application No. 747,878 filed Dec. 6, 1976, now abandoned, by the same inventors, a process is described for reducing the linting propensity of a mechanical pulp, in which process the fraction or fractions of the pulp below a certain specific surface are subjected to additional mechanical working. Knoweldge of the fractional distribution by weight of fibre specific surface in such a pulp is, of course, of great help in deciding how big a fraction of the pulp should be thus reworked.

BRIEF DESCRIPTION OF THE INVENTION

Broadly the present invention relates to an apparatus for use in determining fractional distribution of fibres by specific surface in a sample of mechanically treated pulp, said apparatus comprising, a hydrocyclone means having an overflow outlet and an underflow outlet, at least two collecting chambers, means for agitating pulp in each of said collecting chambers, pump means to feed pulp to said hydrocyclone means, means to selectively connect said pump means with each said chamber to feed pulp from said selected chamber to said hydrocyclone means, means for selectively directing material discharged from one of said overflow and said underflow outlets to a selected one of said chambers and means for measuring the amount of pulp collected in said selected one of said chambers.

DRAWINGS

In the drawing

DETAILED DESCRIPTION OF THE INVENTION

The apparatus of the invention consists of a hydrocyclone adapted to discharge either the underflow fraction or the overflow fraction into a series of consecutive separate receptacles or a series of separate compartments of a single receptacle. By underflow fraction is understood the fraction discharged from the apex outlet of the hydrocyclone and said outlet is accordingly denoted as the underflow outlet; while by overflow fraction is understood the fraction discharged from the outlet opposite the apex and said outlet is accordingly denoted as the overflow outlet. The underflow fraction tends to be enriched in fibres of low specific surface so that a fractionation based at least in part on specific surface occurs in the hydrocyclone. Several hydrocyclones can be used, each discharging into one or more compartments but it may be preferred to use one hydrocyclone adapted to be connected or positioned to discharge pulp into the respective compartments or chambers. Each of the compartments is connected by a suitable connection line, e.g. a pipe or hose, through a pump to the inlet of the hydrocyclone, each such connection line being fitted with a valve to open or shut the flow of pulp slurry from such compartment to the hydrocyclone. In addition, each of the compartments is provided with an outlet for the removal of a sample of pulp from each such compartment. The receptacle containing the desired number of compartments, will generally be stationary, e.g. placed on a stationary support, while suitable support is provided for the movement of the hydrocyclone into selected positions to discharge at a selected compartment e.g. a frame fitted with a horizontal rail along which the hydrocyclone, fitted with a suitable bracket, can be made to slide. Alternatively, the hydrocyclone may be stationary, and the receptacle provided with means for moving relative to it or suitable piping provided to selectively connect an outlet of the hydrocyclone to the desired compartment.

Figure 1:
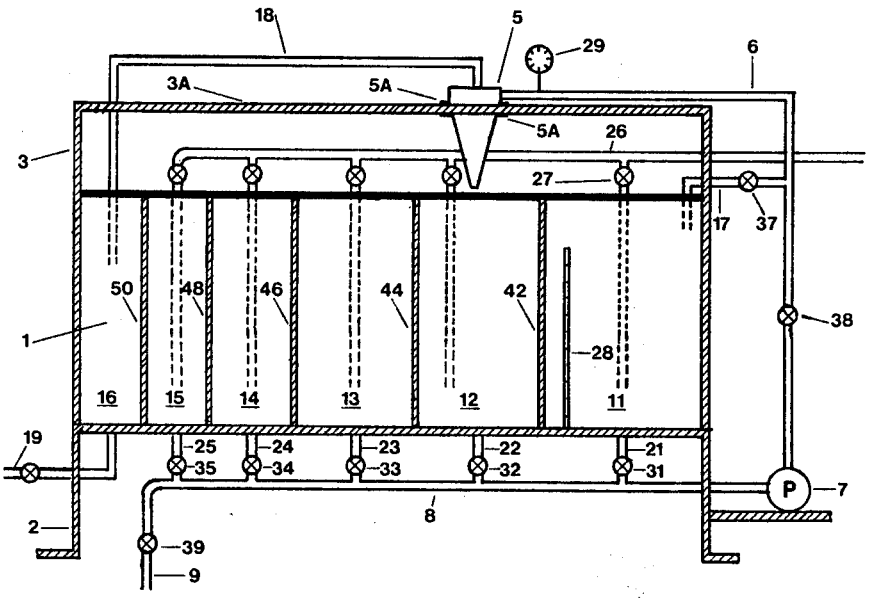
FIG. 1 is a schematic representation of a particular embodiment of the apparatus of the invention.

Referring more particularly to FIG. 1, 1 denotes a receptacle divided into six compartments designated respectively by numbers 11 to 16. The receptacle 1 may be made of any suitable material, e.g. it may be convenient to make it in glass or transparent plastic, such as plexiglass to enable the operator to read the level of slurry in each of the compartments, but it can also be made of stainless steel or the like, with a sight-glass provided for measuring the level of slurry. Receptacle 1 is supported by support 2, and an upper frame 3 is provided with a horizontal rail 3A, along which hydrocyclone 5 is made to slide via bearings 5A. The hydrocyclone may be supported on the rail by means of a bracket fitted on the hydrocyclone and adapted to glide along the rail, or by any other means. The hydrocyclone is of conventional construction and of a suitable size for laboratory use, e.g. a 5 cm diameter hydrocyclone having an inlet diameter about 8.5 mm, an overflow outlet of 11 mm and an underflow outlet diameter selected between 8 mm and 4 mm in accordance with the fraction being processed. The inlet of the hydrocyclone is connected via line 6 and pump 7 with collector line 8 which, in turn, is connected with the individual compartments 11, 12, 13, 14 and 15 by respective lines 21, 22, 23, 24 and 25, each fitted with a valve (respectively 31, 32, 33, 34 and 35) to open or shut the flow of pulp slurry through said line. Sampling outlet 9 is also connected with collector line 8 and is fitted with a valve 39 to open or shut the flow of pulp slurry therethrough. Line 8 may be slightly inclined in the direction of outlet 9 to facilitate flow by gravity. Recirculation line 17, fitted with valve 37, provides a by-pass for the slurry pumped to the inlet of the hydrocyclone. This line 17 is adapted to be selectively connecting to the compartment from which the pulp is being pumped. Gauge 29 indicates the hydrocyclone inlet pressure. Control of the pressure serves to control the volumetric flow rate through the hydrocyclone and this may be accomplished by adjusting the valve 38 in line 6 to throttle the pump 7 or by adjusting in amount of recirculation via valve in line 17 or both. The overflow outlet of the hydrocyclone is connected with line 18 for discharge of the overflow fraction into compartment 16 from where the accumulated slurry may be evacuated via outlet 19. The line 18 is adapted to be connected to discharge into the supply compartment at the beginning and end of each test as will be described hereinbelow. Air line 26, with branches leading into each of the compartments 11 to 15, (exemplified by 27 leading into compartment 11) is provided as an agitator or a mixing means to ensure uniform consistency of the slurry in each compartment, it is connected to a suitable source of air (not shown). In each compartment a yardstick or a graduated sight-glass, as the case may be, is provided permitting visual determination of the level of the slurry in each compartment; only one such yardstick, 28 in compartment 11 is shown in the drawings. However each compartment will normally be provided with one. The lines 6 and 18 which are connected with the movable hydrocyclone represent pipes or hoses which are flexible or extensible and may, e.g. be coiled or uncoiled to follow the movement of the hydrocyclone from one end of the apparatus to the other. The line 18 must also be adapted to be connected, to discharge selectively into each of the compartments in the same manner as the line 17.

Depth of each of the compartments 11 to 15 inclusive i.e., the height of the yardstick (sight-glass) 28 etc. should preferably be substantially constant and the compartments sized so that the fraction collected in these compartments when diluted to the required consistency will attain about the same level in each compartment. This results in more uniform accuracy in measuring the flow. If the height of the compartment is to be constant each of the compartments must be reduced in cross-sectional area in accordance with the percent solids i.e., fibres etc. in the feed to be accumulated in such compartment. Thus for a given installation knowing the amount of the fraction to be collected (the underflow outlet size for given operating conditions) the volume of the compartment can be calculated. The compartments 12, 13, 14 15 progressively decrease in width i.e. the spacing between the dividing walls 32, 44, 46, 48 and 50 progressively reduces. Obviously such a reduction in area could also be obtained by appropriately changing the third dimension (into the paper) to thereby change the volume of the compartments while maintaining the height substantially constant.

It is not absolutely essential that the compartments be dimensioned so that the depth of the liquid in each chamber will be substantially constant when diluted to the required consistency, however, as above indicated it is a preferred mode construction since it improves the accuracy of the equipment and facilitates operation.

The operation of the apparatus is as follows: A sample of the pulp is diluted to a selected consistency suitable for fractionating a pulp in a hydrocyclone, viz. one between 0.05 to 0.3% preferred 0.1 to 0.15% and placed in compartment 11. The level of slurry in compartment 11 is noted, the hydrocyclone is positioned above compartment 11, the lines 17 and 18 positioned to discharge into compartment 11 and pump 7 is activated. While the pump is working, valve 31 is open. When stable operation is attained the hydrocyclone is moved into position over compartment 12 and the line 18 positioned to discharge into chamber 16. The underflow fraction is collected in compartment 12, while the overlow fraction is collected in 16 and used in any suitable manner or discarded. When the required sample has been collected in compartment 12 the hydrocyclone is again positioned over, and the line 18 connected to discharge into, the compartment 11, the pump is stopped (and valve 31 closed), and the level of slurry in 11 is measured. Positioning the cyclone and line 18 to discharge into compartment 11 when the pump is stopped permits the system to drain into the sample feed. The difference in level in compartment 11, the consistency of the slurry being known or determined, gives a measure of the weight of fibre fed to the hydrocyclone. A cross-check of the weight is provided by the volumetric flow rate which, given the time of flow and the consistency, permits the determination of the weight. Valve 31 may now be opened again, at the same time as valve 39, and a sample taken from compartment 11 for a laboratory determination of specific surface. The compartments 11 and piping 8 is then washed and the valves 31 and 39 are then closed. The slurry in compartment 12 is diluted to substantially the same consistency as was previously selected in compartment 11, the level of the slurry in compartment 12 is noted, the hydrocyclone is positioned over and the line 18 is positioned to discharge into compartment 12, valve 32 is opened and the pump 7 is set in operation. After stable operation of the cyclone is attained, the cyclone is positioned to discharge into compartment 13 while line 18 is positioned to discharge to compartment 16 and a new underflow fraction is now collected in compartment 13. After the sample has been collected the cyclone and line 18 are positioned to discharge into compartment 12 again and the pump is stopped. When the pump is stopped and valve 32 closed, the level of the slurry remaining in compartment 12 is measured, and this remaining slurry may be removed by opening valves 32 and 39 as described hereinabove for chamber 11 i.e., a sample is taken for a determination of the specific surface and consistency of the slurry in compartment 12 and the piping 8 and compartment 12 are then cleared. The procedure is repeated with the hydroclone discharging into compartment 14 and 15 etc. whatever the number of compartments provided or fractionation desired. Since the specific surface, consistency and amount of sample are known the amount by weight of pulp in the underflow fraction having the specific surface measured may be determined.

The hydrocyclone separates the pulp into an overflow fraction and an underflow fraction. The relative size of the fraction, for a given pulp as is well known, is, in a hydrocyclone of given geometry (maximum diameter, cone angle etc) a function of the relative size of the openings, namely the inlet, overflow and underflow openings. When the fractionation is made on the basis of consecutive underflow franctions, it will be necessary to use decreasing underflow openings as the hydrocyclone is positioned over consecutive compartments, otherwise the underflow fraction ("reject rate") will tend towards unity i.e., 100% of the feed. The underflow opening of the hydrocyclone is reduced, e.g. by applying tips of smaller diameter or otherwise reducing the diameter of the outlet, as the hydrocyclone is moved from one compartment to the next. Theoretically, a large number of tips of decreasing size should be used but in practice a limited number of tips will be quite satisfactory for effective fractionation. For example, with a hydrocyclone of a maximum diameter of about 5 cm. a cone angle 5°, an inlet diameter of 8.5 mm. and an overflow outlet diameter 1.1 cm., a tip or underflow outlet of 8 mm. is used when the hydrocyclone is discharging to compartment 12 and 13, a diameter of 4 mm. is used for compartment 14 and 15, and so on. The selection of the size of the tips and of the number of the different tips is a function of the desired "fineness" of the breakdown, or number of fractions, and is well within the skill of the man familiar with the art. For the above specific example the volumes of the compartments 11 to 15 that were substantially filled were respectively 0.144, 0.108, 0.072, 0.036 and 0.018 cu. meters. The height of each compartment was 60 cm.

Figure 2:
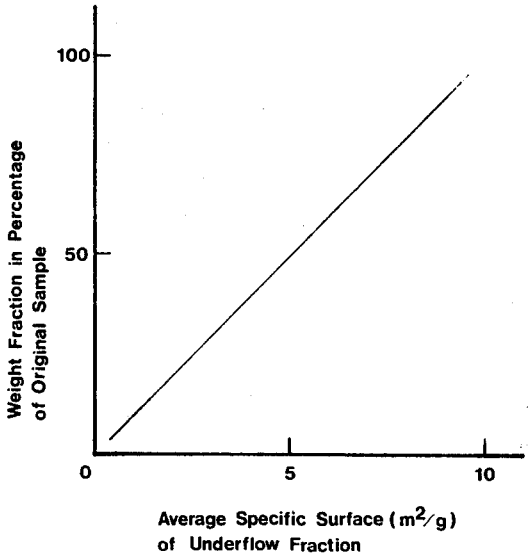
FIg. 2 shows a typical fractionation curve obtained by means of this.

The weight of fibre in each underflow fraction being thus determined (from the level of slurry in the corresponding compartments at the measured consistency), the ratio of such weight to the weight of fibre in the initial sample is easily calculated. The specific surface of each such fraction withdrawn through outlet 9 having been determined by known laboratory methods, it is now possible to draw a cumulative distribution curve of specific surface by plotting the values of average specific surface of the underflow fractions versus the corresponding weight fraction. A representation of such a plot is shown in FIG. 2.

The above described apparatus refractionates consecutive underflow fractions, whereby the fractional distribution of fibre specific surface is obtainable. It is also apparent that with suitable modifications e.g. inversion of the hydrocyclone and connection of the underflow or apex outlet to line 18 and discharging through the overflow outlet into the selected compartments 12 to 15 inclusive (or whatever number of compartments are used) the overflow fraction could be examined in a similar manner and the cumulative distribution curve of specific surface for the overflow fraction could be obtained. It is also apparent that the tip sizes i.e., underflow outlets will be adjusted to obtain the required or desired percent by weight of overflow fraction to obtain the required fractional distribution. It has been found in operating in this manner that the consistency normally does not require adjustment since there will be only a small change in consistency between feed and collected overflow fractions.

While the average specific distribution of the overflow fractions may be obtained, it is generally the underflow fraction that is of main interest since this fraction presents the most difficulties in the operation of paper machine, particularly in relation to lint. Thus one would normally collect the underflow fraction and determine the fractional distribution by weight of fibre specific surface for the underflow fractions.

Modifications may be made without departing from the spirit of the invention as identified in the appended claims.

What we claim is:

1. An apparatus for use in determining the fractional distribution by weight of fibre specific surface in a sample of mechanically treated pulp comprising; hydrocyclone means having overflow and underflow outlets, at least two separate collecting chambers, means for agitating pulp in each of said chambers, feeding means for feeding pulp to said hydrocyclone means, means to selectively connect each one of said chambers to said feeding means to feed pulp from a selected one of said chambers to said hydrocyclone means, means for selectively connecting each of said chambers to a selected one or both of said overflow or underflow outlets thereby to collect one after another a separate fraction of said pulp in each of said chambers and to feed one after another each of said collected fractions to said hydrocyclone means, means for measuring the amount of pulp fed to said hydrocyclone means, and means for measuring the amount of each said separate pulp fractions.

2. An apparatus defined in claim 1 wherein said hydrocyclone means comprises a single hydrocyclone and wherein said means for selectively connecting connects said underflow outlet to discharge selectively into another selected one of said chambers of said at least two chambers.

3. An apparatus defined in claim 2 wherein said means for selectively connecting comprises means mounting said hydrocyclone to move relative to said collecting chambers, thereby to position said underflow outlet to discharge selectively into said another selected chamber of said at least two collecting chambers.

4. An apparatus as defined in claim 1 wherein at least three collecting chambers are provided.

5. An apparatus as defined in claim 4 wherein said chambers are of different volume are arranged in a sequence of decreasing volumes.

6. An apparatus as defined in claim 5 wherein said hydrocyclone means comprises a single hydrocyclone and said means for selectively connecting comprises means moveably mounting said hydrocyclone means to position said one of said underflow and said overflow outlet to selectively discharge into another selected one of said at least two collecting chambers.

7. An apparatus as defined in claim 5 wherein said chambers are all substantially the same height.

8. An apparatus as defined in claim 7 wherein each said chamber is of a volume to be substantially filled by the fraction received therein when said fraction is at substantially the same consistency as said sample.

9. A method of determining the fractional distribution by weight of fibre specific surface of a mechanically treated pulp sample comprising; feeding said sample to a hydrocyclone means, thereby to fractionate said pulp into an underflow fraction and an overflow fraction, said underflow fraction being enriched in low specific surface fibres, collecting one of said fractions discharged from a selected one outlet of said hydrocyclone in a chamber, measuring the specific surface of said sample, adjusting the consistency of said collected fraction to be substantially equal to the consistency of said sample, measuring the amount of said one fraction, fractionating said consistency adjusted collected fraction in said hydrocyclone means into a second underflow fraction and a second overflow fraction, collecting one of the said second underflow fraction and second overflow fraction discharged from said selected one outlet of said hydrocyclone means thereby to form a second collected fraction, measuring the amount of said second collected fraction, measuring the specific surface and consistency of said collected and said second collected fractions, and repeating said process to obtain the desired fractional distribution by weight of fibre specific surface of said pulp sample.

10. The method as defined in claim 9 wherein said collected fractions are underflow fractions.

* * * * *